US007201630B2

(12) United States Patent
Cope

(10) Patent No.: US 7,201,630 B2
(45) Date of Patent: Apr. 10, 2007

(54) MANUALLY SUCTIONED PRESSURE-INDUCED BREAST ENHANCEMENT DEVICE AND METHOD

(76) Inventor: April E. Cope, 57 Conestee St., Asheville, NC (US) 28801

( * ) Notice: Subject to any disclaimer, the term of this patent is extended or adjusted under 35 U.S.C. 154(b) by 143 days.

(21) Appl. No.: 10/981,050

(22) Filed: Nov. 3, 2004

(65) Prior Publication Data

US 2005/0101222 A1 May 12, 2005

Related U.S. Application Data

(60) Provisional application No. 60/519,029, filed on Nov. 10, 2003.

(51) Int. Cl.
*A41C 3/12* (2006.01)
*A61H 37/00* (2006.01)
*A41C 3/00* (2006.01)

(52) U.S. Cl. ..... 450/38; 601/14; 600/38

(58) Field of Classification Search ..... 480/37, 480/38, 55, 59; 2/267, 268, 67; 601/6–14; 128/897, 898; 600/38–41; 604/74–76; 606/201, 606/97, 98

See application file for complete search history.

(56) References Cited

U.S. PATENT DOCUMENTS 1,220,707 A 3/1917 Vilguards
3,785,369 A * 1/1974 Tallent ..... 601/14
3,913,569 A * 10/1975 Kanonas ..... 601/14
4,111,192 A 9/1978 Wu
5,520,613 A * 5/1996 Copelan ..... 601/14
5,662,583 A 9/1997 Houri
5,676,634 A 10/1997 Khouri
5,695,445 A * 12/1997 Khouri ..... 600/38
6,042,537 A * 3/2000 Kaiser ..... 600/38
6,080,037 A * 6/2000 Lee et al. ..... 450/38
6,101,630 A * 8/2000 Lee ..... 2/57
6,241,575 B1 * 6/2001 Shailer ..... 450/38
6,354,906 B1 * 3/2002 Liu ..... 450/38
6,478,656 B1 11/2002 Khouri
6,514,200 B1 2/2003 Khouri

* cited by examiner

*Primary Examiner*—Gloria M. Hale
(74) *Attorney, Agent, or Firm*—Carter Schnedler & Monteith, P.A.

(57) ABSTRACT

A method of breath-powered sustained pressure induced breast tissue expansion by way of sucking air through silicone tubes attached to semi-rigid plastic domes cushioned by sticky silicone padding and clamping or locking the air pressure inside the domes to create tension on the breasts to enlarge them over a period of at least ten weeks of wear for ten hours per day or night, further including optional improved domes with silicone padding extensions on the outer edges of the domes below the armpits and hooks in back like a bra to create an improved seal to keep the air pressure in while wearer moves about in her daily activities.

15 Claims, 7 Drawing Sheets

MANUALLY SUCTIONED PRESSURE-INDUCED BREAST ENHANCEMENT DEVICE AND METHOD

CROSS REFERENCE TO RELATED APPLICATIONS

This application claims the benefit of provisional patent application Ser. No. 60/519,029 (confirmation number 4600) filed Nov. 10, 2003 by the present inventor.

FEDERALLY SPONSORED RESEARCH

Not applicable

SEQUENCE LISTING OR PROGRAM

Not applicable

BACKGROUND OF THE INVENTION—FIELD OF INVENTION

This invention relates to pressure-induced tissue enhancement devices, specifically related to enhancing and increasing breast tissue.

BACKGROUND OF THE INVENTION—PRIOR ART

It is a long-established scientific finding that external pressure against biological soft tissue will grow the tissue if the pressure is sustained over a period of time. Proof of this technological phenomenon has been exhibited in bone, skin, muscle, blood vessels, other isolated tissue cultures and on breast tissue. Patents reflecting this prior art include the following:

67,663 8/1867 Mattson 128/38
72,604 12/1867 Cole 12/281
1,312,619 8/1919 D'Orsay 128/40
1,599,628 9/1926 Ahlgren 128/138X
2,211,214 8/1940 Miller 128/38
2,249,500 7/1941 Shirleye A1. 128/38 UX
2,616,417 11/1952 Holbrook 128/38
3,382,867 5/1968 Reeves 128/38
4033,338 7/1977 Igwebike 128/38

More recently, noninvasive devices have been invented for pressure-induced tissue expansion on soft tissue including female breasts by inventor Roger K. Khouri for Brava LLC under Pat. Nos. 5,695,445, 5,662,583, 6,500,112, 6,641,527. This inventor has created and marketed a bra-like device with semi-rigid plastic domes surrounded by silicone cushions that are placed over the breasts, connected to an electronic battery operated pump device that creates and regulates pressure within the domes. This contraption can be worn over a period of ten or more weeks to create an effect of breast enlargement Khouri acknowledges in Pat. No. 6,641,527 that a problem with this device is that it is not very discrete for women to wear because the seal around the breasts often comes loose and pressure must be regained, which can interfere with a person's activities. If the seal comes loose, which it often will under the strain of normal body movement, the pressure regulator will make a suction sound over a matter of approximately five to twenty minutes or more to bring the pressure back. This can be quite time-consuming, inconvenient and indiscrete for the wearer of the device. In his patent Khouri proposes a hand-held pump that could be used to regain the pressure. However, this is also a cumbersome and awkward way of bringing the pressure back around the breasts. With the present invention described in this application, I have solved several of these and other potential problems while focusing on a breath-suctioned method of achieving and maintaining the pressure inside the domes.

As a macro-power source can come from organic or environmental sources such as wind and water, so can a micro-power source come from a natural source such as ones own breath. With the current invention, the wearer of the rigid dome structures over the breasts can use her own breath to suck the pressure into the domes in a minute or less. The device that enables this, at its most basic level, is a structure of two silicone tubes that connect to semi-rigid domes around the breasts and connect to a single tube wherein the wearer of the "bra" can hold the end of the single tube, or each connecting tube and suck in air as if on a straw, to create the desired pressure within the domes. The benefits of this breath-suctioned device over the electronic or hand held pump are such that 1) The pressure can be gained initially, or re-gained if the seal comes loose, almost immediately and 2) There is no need for a bulky and awkward electronic box to place inside the bra in case of leakage of air 3) There is no need to depend on an electrical power source, enabling a more travel-friendly process as well as there being less likelihood for the system to malfunction or break down. The wearer can rely solely on her own breath to power the device. The device will contain a lock or clamp to keep the pressure in after the air is sucked in. If the seal comes loose around the domes, she can pull the tube to her mouth and bring the pressure back. Many women have been frustrated with the battery-operated box that must be recharged each night and that goes off indiscreetly and takes a long time to re-pressurize. With this breath-powered tube, these frustrations can be eliminated The optimal pressure level for the tissue expansion is 20 mmHg. This can be estimated, as it is a pressure that is not painful, but is a safe and comfortable pressure. The wearer of the device can regulate the pressure herself and simply not suck the air pressure to the point where it is uncomfortable. Another variation of the device would be a small pressure meter at the end of or in the cross section of the tubing to allow the wearer to know exactly how much pressure she has created. However this is not necessary to the successful functioning of the device. This description of the manually breath-powered suction device in its application to semi-rigid plastic domes that fit over the breasts is the focal point of this invention. The second aspect of the invention is an improvement on the dome structures themselves, which will be described in the following paragraph.

The domes that fit over the breasts need to be as stationary and secure as possible in order for the necessary pressure to be maintained inside the domes. Thus, another problem with the Brava system (Khouri's current invention) arises, wherein the silicone on the rims of the plastic domes often will fold inward towards the breasts, especially on the outer edges underneath the armpits due to more bodily movement occurring there and effecting the seal against the skin and letting air escape. Since the whole system must remain completely airtight for the pressure to be maintained, this has been a continuing problem for Brava users. In conjunction with the manual breath-powered tubing device, another improvement on the system as a whole would be in relation to the silicone "tacky" padding around the edges of the domes. In this improved carnation, the domes would contain an extended silicone edge on each outer side of the domes that would be attached to a strap to be pulled back around the rib cage. This would allow the wearer to pull this edge outward, securing the silicone against more skin and stretched toward the back, which would help to keep the seal stabilized. This extra silicone would be encased in a vinyl or similar material and continue to wrap around the chest of the wearer, latching in back similar to a traditional bra. The domes would also be latched in the front to keep them more stable, different from the current version of domes, which include two single domes with a minimal amount of silicone padding. As they are now, the domes are separate pieces from the rest of the system, and a garment to secure them must be worn overtop. With this particular improvement, the silicone would wrap around the body connected to the garment on the outer edges so that there would not be as much of a chance for the silicone to lift from the skin during movement.

SUMMARY

In accordance with the present invention, a tubing device for breath suction to create pressure inside plastic domes cushioned and sealed to the skin by silicone extending around the sides of the domes and latched at the back, wherein the domes cover the breasts for the purpose of breath-powered pressure-induced tissue enhancement on the breasts.

DRAWINGS

FIG. 7 shows a close up of the clamp and mouthpiece for the wearer to suck air out of.

DRAWINGS—REFERENCE NUMERALS

Figure 1:
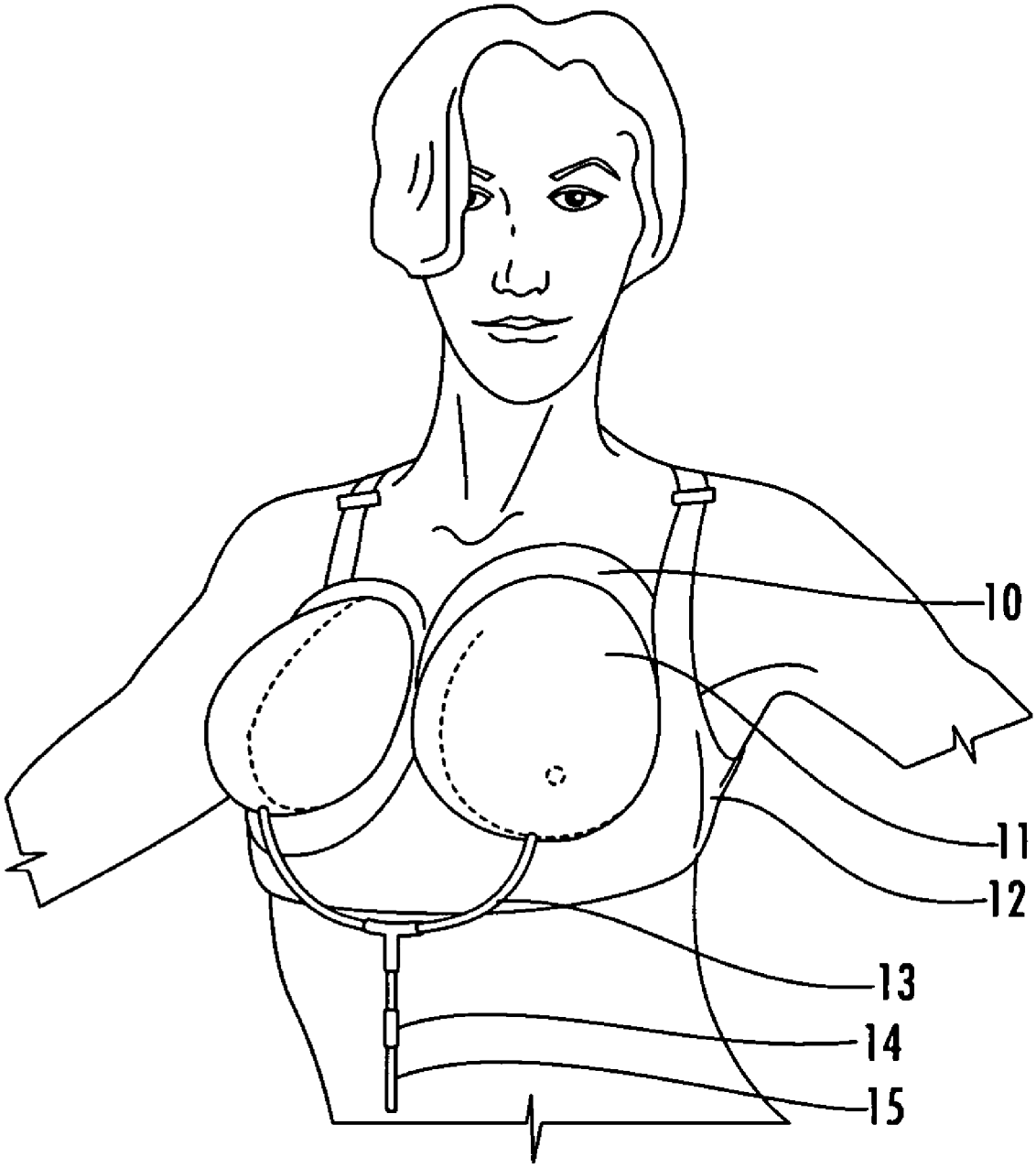
FIG. 1 shows the tubing device connected to the domes and held in place by a garment that is partially silicone lined under the arm, which is an extension of the silicone padding that rims the plastic domes.
Figure 2:
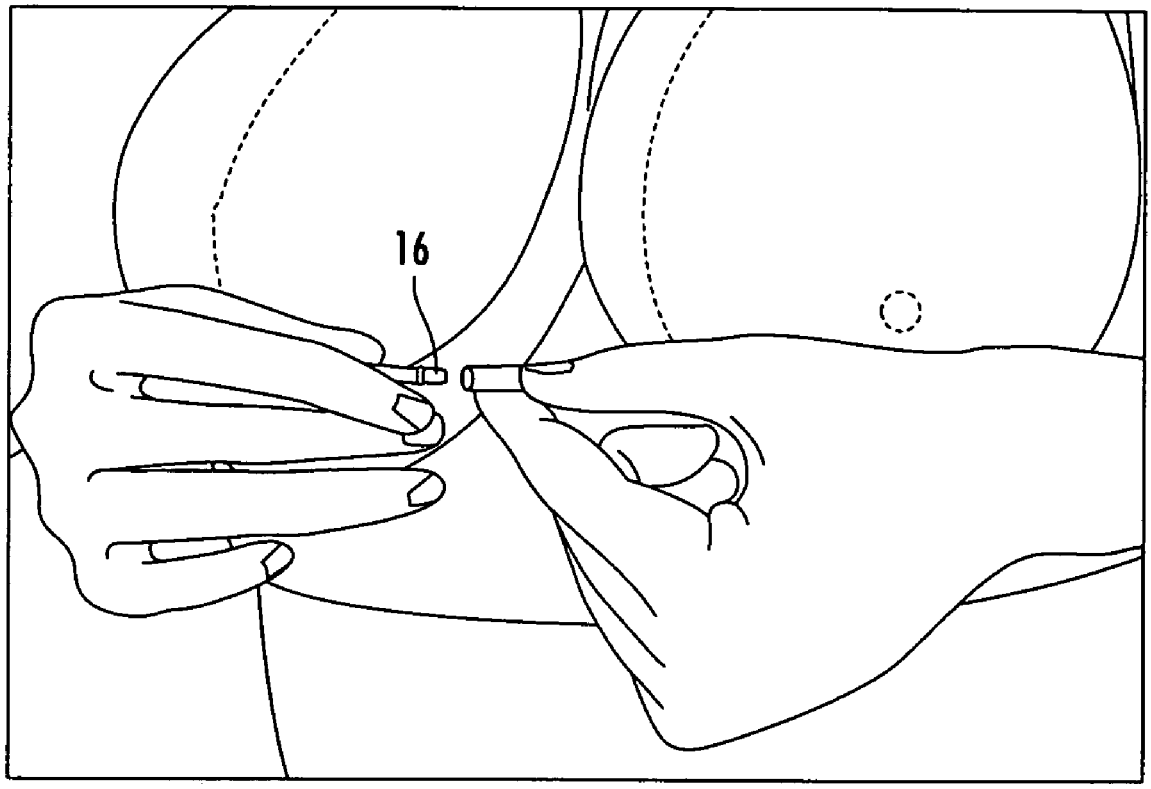
FIG. 2 shows where on the domes the tubing is connected to the plastic domes.
Figure 3:
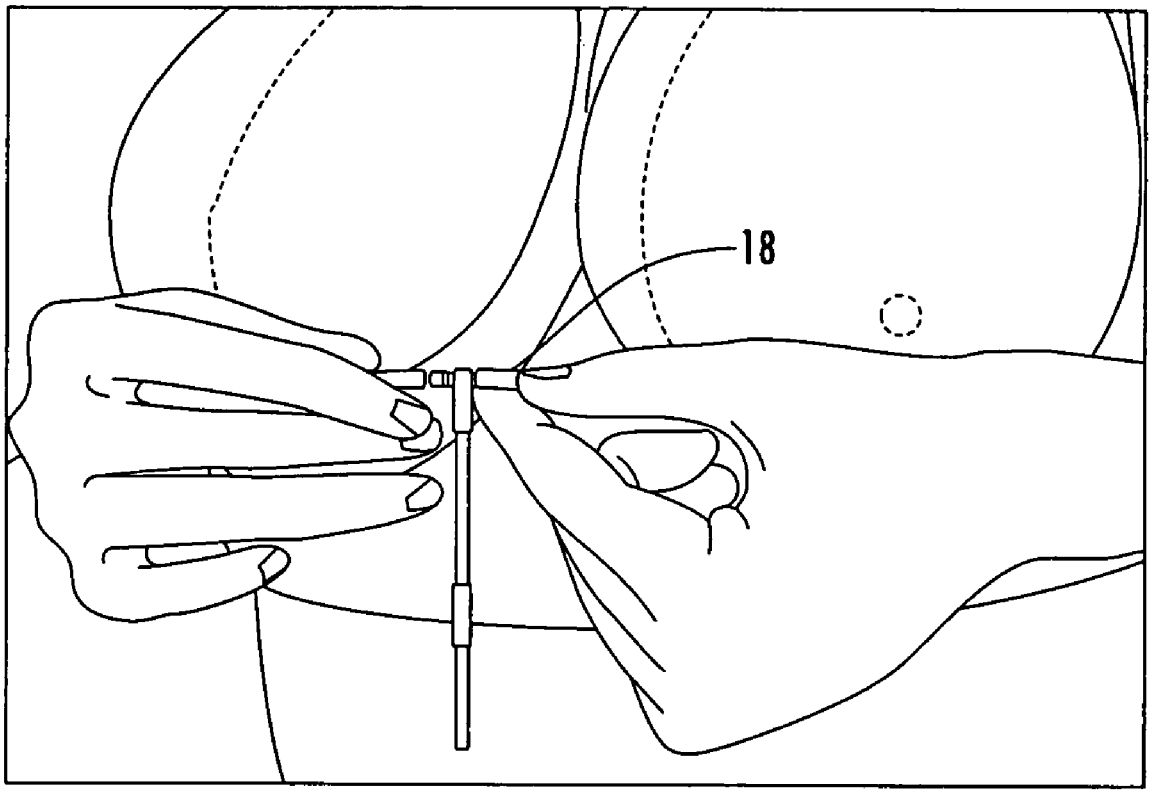
FIG. 3 shows where the silicone tubing connects to the other tubes.
Figure 4:
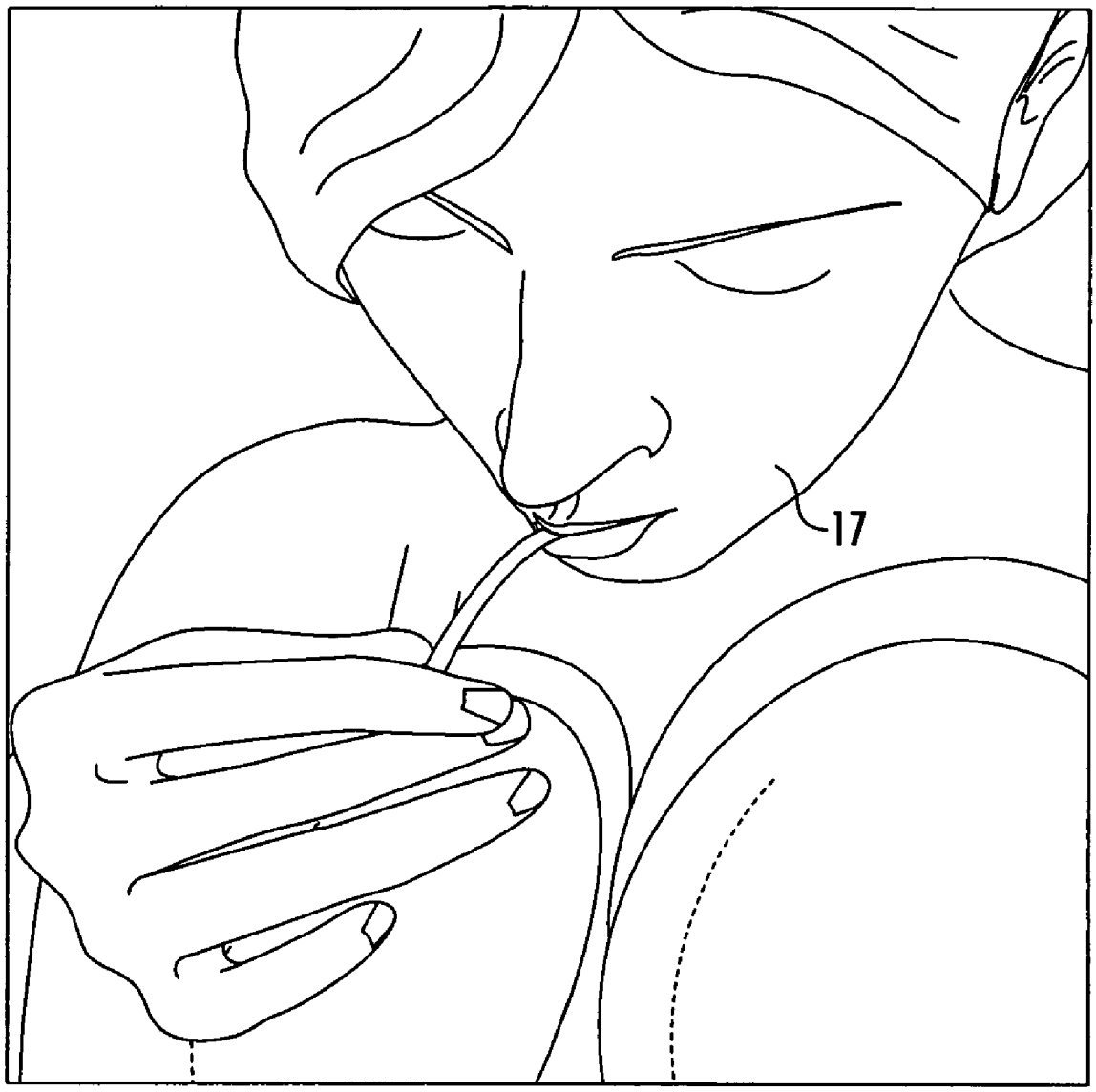
FIG. 4 shows the wearer of the device sucking in air pressure on the end of the single tube.
Figure 5:
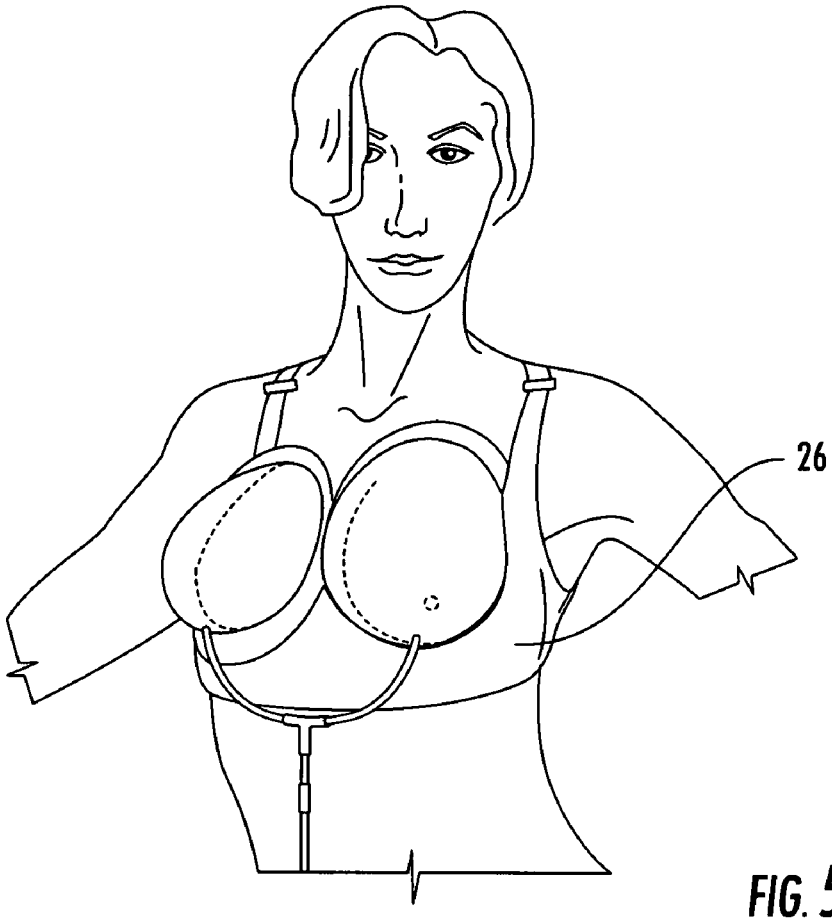
FIG. 5 shows extended silicone panels on outer edges of domes encased in fabric.
Figure 6:
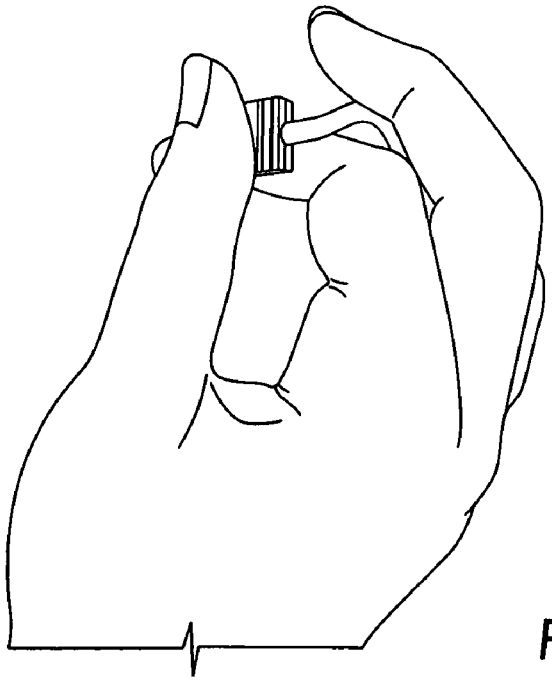
FIG. 6 shows the wearer pushing down on the clamp to lock in the air pressure.
Figure 7:
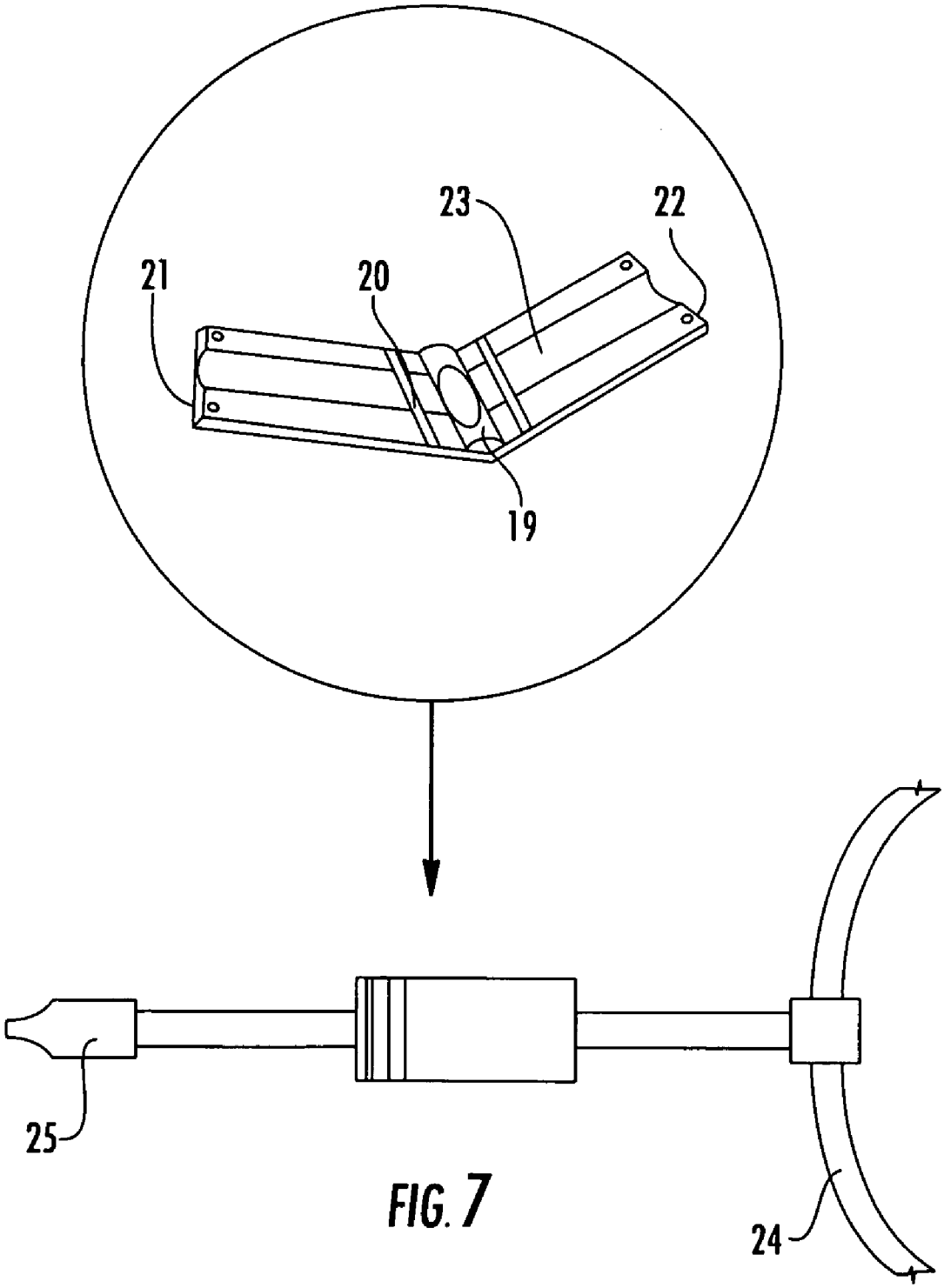
Figure 8:
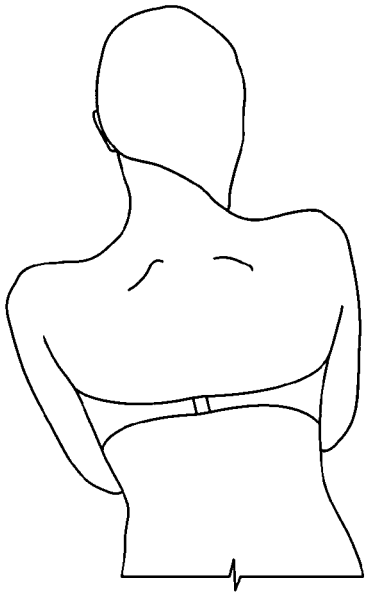
FIG. 8 shows the latching of the silicone lined garment in the back.

10 silicone rim around domes
11 semi-rigid plastic domes
12 portion of sports bra lined with "tacky" silicone
13 silicone tubing
14 clamp to lock air pressure into tubing and domes
15 plastic mouthpiece for suction
16 opening in domes to connect to tubes
17 woman sucking air pressure into the mouthpiece that connects to tubes and domes
18 plastic Y or T connector
19 hinge for clamp
20 close up of clamp
21 peg holes for clamp
22 pegs for clamp
23 place where tube is threaded through hole
24 tubes that connect to domes
25 close up of mouthpiece
26 extra panels of silicone padding extending from edge of domes encased in fabric
27 standard pressure meter

DETAILED DESCRIPTION—PREFERRED EMBODIMENT

A preferred embodiment of this invention is illustrated in FIG. 1 through FIG. 8. In FIG. 1, the semi-rigid plastic domes 11 that are rimmed with "tacky" silicone padding 10 are placed around the breasts so the breasts are not touching the inner shell and are secured by a sports bra that is silicone-lined and attached to the domes specifically below the armpits with an extended panel of silicone stretching from the outer edge of the domes below the armpit 12 and fastened like a traditional double or triple hook and eye bra in the back. This extra silicone provides the advantage of limiting the shifting of the domes in order to keep the seal from coming loose when the wearer is moving about. Silicone tubing is attached to raised openings in the plastic domes FIG. 5–16 and then connected to a Y connector FIG. 3–18 with the tube connecting to the bottom of the Y connector containing an open clamp 14 (more detailed illustration in FIG. 7–20, 21, 22, 23) and followed by a plastic mouth piece FIG. 1–15 (more detailed picture in FIG. 7–25) attached to the end of the tube. The method of achieving the desired sustained pressure with these components is for the wearer to pull the plastic mouthpiece to her lips and suck in the air pressure FIG. 4–17 as if sucking on a thick milkshake. When the pressure is firm yet not uncomfortable, the wearer squeezes the single tube with one hand while pressing down the clamp with the other to lock the air pressure in. If the domes are situated properly on her chest so that there are no leaks of air, the pressure should stay at this constant sustained pressure as long as no air escapes the domes. The domes can be attached in the center as well or worn open depending on the anatomy of the wearer and which way best secures the domes in place on her chest. If some or all of the air pressure escapes the domes, she must repeat the process to regain the pressure.

The thickness of the silicone padding around the dome rims should be approximately one inch thick and extend approximately two centimeters outside and inside the edges of the domes to protect the skin from the plastic rims. The extended connected panels encased in the sports bra, however, should begin to thicken to a greater thickness than the rest of the rims, approximately one and a half inches and then slowly taper away as it stretches toward the back. The added thickness, as the silicone extends beyond the rims of the domes, will help to keep the domes stationary because of its sticky nature and latch to the skin that often stretches and moves, keeping the air from escaping the seal of the domes. The silicone tubing can vary but may typically be ¼ inch in outside diameter and ⅛ inch inside diameter and fit snugly over the raised approximately one centimeter openings in each dome. The size of the clamp FIG. 7 can vary as well but must be tailored to the tube so that the plastic ridges that close down on the tubing will completely stop any air from escaping the tube, yet not damaging the tube. The clamp will contain a hole for the tube to be threaded into 23, plastic raised ridges to clamp down on the tube 20, and pegs to secure the clamp 22. The plastic mouthpiece will be glued to the end of the tube and be approximately one inch long and taper inward to a comfortable width for orally suctioning, much like a cigarette holder.

Figure 9A:
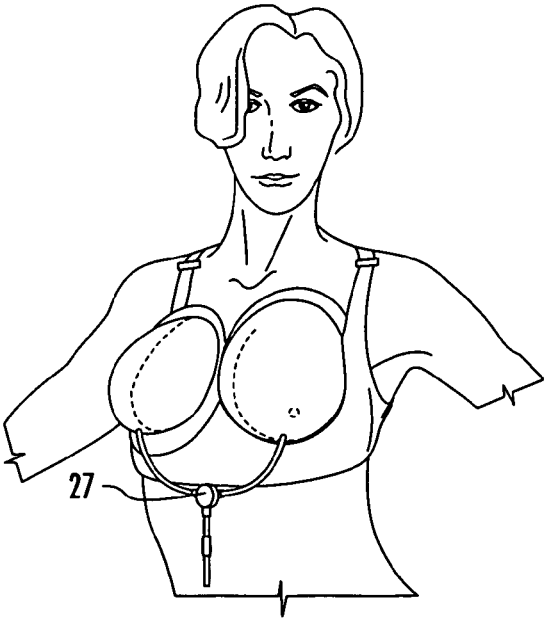
FIG. 9A shows alternative air pressure meter connected as a Y connector to the tubing device.

FIG. 9A Additional Embodiments

An additional embodiment to the device is illustrated in FIG. 9A where the Y connector can be replaced with a hand-held traditional air pressure meter customized to show the wearer how much pressure she has gained.

Figure 9B:
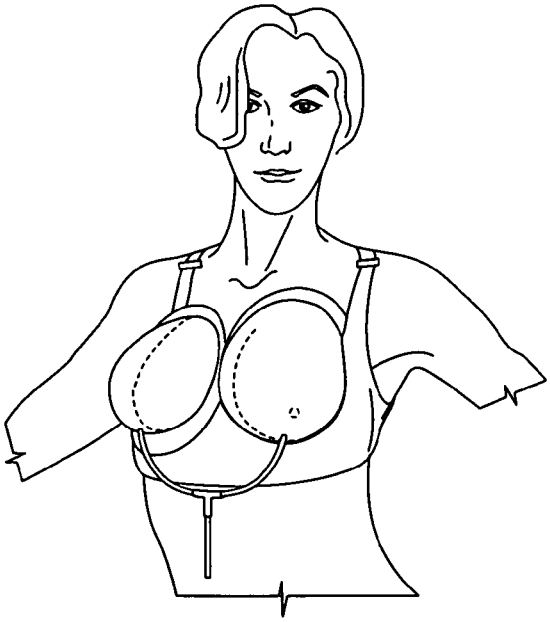
FIG. 9B shows a simplified version of the tubing and air-locking device without the clamp or mouthpiece.

FIG. 9B Alternative Embodiments

An alternative and even more simplified embodiment is illustrated in FIG. 9B where the tubing that connects to the domes does not include a pressure meter or a clamp or a mouth piece, but instead includes simply a blocked tube to lock the pressure in. The wearer must in this case hold each tube that connects to each dome one by one and suck the pressure into the domes and then reconnect the tubes to the Y connector. The wearer would get the same results this way, however the method would be slightly more difficult to achieve than the previous embodiments.

Alternative Embodiments

Another simplified version of this invention may use the manual suction tubing device in any of its embodiments with traditional domes that do not have the extra panel under the arms.

Advantages

From the descriptions above, a number of advantages of my manually suctioned breast enhancement system become evident:

(a) With the use of the mouth-suctioned tubing device connected to the domes, the user will experience an improved convenience where she will be able to go anywhere and wear the garment without needing to rely on an external power source of an electronically charged or battery operated box to control the pressure inside the domes. She will simply be able to rely on her own breath and minimal hardware to enlarge her breasts naturally over a sustained period of time.

(b) If the pressure inside the domes decreases or if the seal comes loose during wear, the user will be able to quickly repressurize the domes by lifting the mouthpiece to her mouth and sucking on the tube for a matter of minutes instead of waiting for a duration of five, ten, fifteen minutes or more with the battery-operated box which slows down the process since in order for the system to work effectively, the pressure must be sustained. In other words, with the manual suction method of gaining the air pressure inside the domes, there is much less of a chance for the air pressure to be lost for an extended period of time which not only makes the process easier and more efficient, but the tissue growth faster, more effective and long lasting, which is consistent with the technology of sustained pressure tissue growth, which relies on a consistency of pressure with as little interruption as possible.

(c) The manual suction method is silent which will eliminate potentially embarrassing situations if the user is wearing the garment with others around who could otherwise hear the buzzing and electronic box regaining the air pressure if the seat comes loose. Since the wearer will feel it immediately if the air pressure is lost, she can rely on her own sensations and be more in control of the process in a much more discrete manner.

(d) The manual suction device will also eliminate potentially embarrassing travel situations, where with the electronic method, airport security might be alerted by the dubious electronic box worn inside clothes. Since the materials included in the manual device are only cloth, silicone and plastic, it would be much less likely for airport security to become alarmed.

(e) The wearer can find a pressure that suits her particular comfort zone instead of relying on a predetermined pressure as with the electron box. This way, the wearer will be more comfortable during the 10 week or more continued wear needed for lasting tissue growth. Since this can feel like quite a long time for the wearer, there is no need for her to be unnecessarily uncomfortable. Consistent with the technology, an exact pressure is not necessary for growth to occur.

(f) With the improvement of the domes, the possibility for a leakage of air is much less likely since the silicone padding around the domes increases and extends (g) outward where movement can otherwise loosen the seal. This will again result in the system being more effective and reliable.

(h) The system will be easier to set up and less intimidating for women who are not as familiar or comfortable with electronic devices.

(i) This system is less likely to interfere with a constant sustained pressure on the breast tissue due to the easy regaining of pressure if pressure is lost, which is the key to the effectiveness of this technology.

Conclusion, Ramification and Scope

Accordingly, it will be clear to the examiner of this application that this breath-powered system and method of achieving sustained pressure-induced tissue growth on the breasts combined with the elements described, will simplify the process, allow for less interruption, make the system more discrete and user-friendly, allowing women to rely solely on the power of their breath and to create the activity of tissue enhancement when they are equipped with the elements of the invention. In addition, the improvement on the domes by adding more silicone padding extending below the armpits will allow for a more stable seal of air pressure inside the domes, which will further alleviate the wearer from constantly regaining the pressure after movement that would otherwise loosen the seal. Compared to the previous version of this type of system which is powered by an electronic box, and has less silicone padding around the domes and none extending below the arms and toward the back, the user of the improved method and system will experience more freedom to socialize and go about regular activities without interruption, travel without worry of alerting security or needing to find electrical outlets to recharge the batteries of the power box, regain air pressure easily and effectively in a matter of seconds or minutes instead of waiting for an external box to recharge the system over a longer period of time, and lastly she will experience more control over the amount of pressure within the domes, allowing her to be more comfortable while using the system.

Although the description above contains many specificities, these should not be construed as limiting the scope of the invention but as merely providing illustrations of some of the presently preferred embodiments of this invention. For example, the elements included in the invention can contain other shapes and/or materials, such as a differently shaped clamp or mouthpiece, or different materials such as plastic, rubber or vinyl or variations of silicone compounds for tubes, connectors, domes, padding, sports bra, etc.

The scope of the invention should be determined by the appended claims and their legal equivalents, rather than by the examples given.

The invention claimed is:

1. A breath-powered breast enhancement system, comprising:

a brassiere configured to be fastened around the rib cage of a female human wearer to receive the breasts of the wearer;

two domes attached to the brassiere such that the domes do not touch the breasts of the wearer, each of the two domes defining a raised opening through which air may flow;

tubing attached to each of the two raised openings defined by the domes;

a connector defining three openings, wherein the tubing is connected to two of the three openings defined by the connector;

a tube connected to the opening defined by the connector that is not connected to the tubing;

a mouthpiece attached to the tube and configured such that the wearer may remove air from the domes by sucking on the mouthpiece, thereby creating pressure on the breasts of the wearer; and a clamp on the tube that may be opened or closed by the wearer, as desired to release or lock in, respectively, the pressure created on the breasts of the wearer.

2. A system according to claim 1, wherein the domes comprise rims, and padding is provided on the dome rims.

3. A system according to claim 1, wherein the padding comprises tacky silicone that creates a seal between the domes and the wearer when the system is maintaining pressure on the breasts of the wearer.

4. A system according to claim 3, wherein the tacky silicone padding is approximately one inch thick.

5. A system according to claim 1, wherein the domes are attached to the brassiere below the armpits of the wearer.

6. A system according to claim 5, wherein the domes are attached to the brassiere with a panel of silicone.

7. A system according to claim 1, wherein the clamp comprises ridges to clamp down on the tube.

8. A breath-powered breast enhancement system, comprising:

a brassiere configured to be fastened around the rib cage of a female human wearer to receive the breasts of the wearer;

two domes attached to the brassiere such that the domes do not touch the breasts of the wearer, each of the two domes defining a raised opening through which air may flow;

tubing attached to each of the two raised openings defined by the domes;

a connector defining three openings, wherein the tubing is connected to two of the three openings defined by the connector;

a blocked tube connected to the opening defined by the connector that is not connected to the tubing;

wherein the connector and the blocked tube thereon may be disconnected from the tubing to allow the wearer to suck on the tubing, thereby creating pressure on the breasts of the wearer, and thereafter to reconnect the connector and the blocked tube thereon to the tubing in order to lock in the pressure created on the breasts of the wearer.

9. A system according to claim 8, wherein the domes comprise rims, and padding is provided on the dome rims.

10. A system according to claim 9, wherein the padding comprises tacky silicone that creates a seal between the domes and the wearer when the system is maintaining pressure on the breasts of the wearer.

11. A system according to claim 10, wherein the tacky silicone padding is approximately one inch thick.

12. A system according to claim 8, wherein the domes are attached to the brassiere below the armpits of the wearer.

13. A system according to claim 12, wherein the domes are attached to the brassiere with a panel of silicone.

14. A method for enhancing the breasts of a female human using breath, comprising:

providing a breath-powered breast enhancement system comprising a brassiere configured to be fastened around the rib cage of a female human wearer to receive the breasts of the wearer; two domes attached to the brassiere such that the domes do not touch the breasts of the wearer, each of the two domes defining a raised opening through which air may flow; tubing attached to each of the two raised openings defined by the domes; a connector defining three openings, wherein the tubing is connected to two of the three openings defined by the connector; a tube connected to the opening defined by the connector that is not connected to the tubing; a mouthpiece attached to the tube and configured such that the wearer may remove air from the domes by sucking on the mouthpiece, thereby creating pressure on the breasts of the wearer; and a clamp on the tube that may be opened or closed by the wearer, as desired to release or lock in, respectively, the pressure created on the breasts of the wearer;

attaching the brassiere around the rib cage of a female human wearer;

ensuring that the clamp on the tube is open;

sucking on the mouthpiece to create pressure on the breasts of the wearer;

closing the clamp on the tube to lock in the pressure on the breasts of the wearer.

15. A method according to claim 14, wherein the clamp provided in said providing step comprises ridges and said closing step comprises clamping the ridges of the clamp down on to the tube.

* * * * *